US010160241B2

(12) United States Patent
Hiruma et al.

(10) Patent No.: US 10,160,241 B2
(45) Date of Patent: Dec. 25, 2018

(54) LIQUID DISCHARGING APPARATUS AND METHOD OF ADJUSTING RAIL SECTION IN LIQUID DISCHARGING APPARATUS

(71) Applicant: Seiko Epson Corporation, Tokyo (JP)

(72) Inventors: Daisuke Hiruma, Matsumoto (JP); Eri Marumoto, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/297,726

(22) Filed: Oct. 19, 2016

(65) Prior Publication Data

US 2017/0106686 A1 Apr. 20, 2017

(30) Foreign Application Priority Data

Oct. 20, 2015 (JP) ..... 2015-206358

(51) Int. Cl.
*B41J 2/01* (2006.01)
*B41J 25/00* (2006.01)
*B41J 19/00* (2006.01)

(52) U.S. Cl.
CPC ..... *B41J 25/006* (2013.01); *B41J 2/01* (2013.01); *B41J 19/00* (2013.01)

(58) Field of Classification Search
CPC . B41J 25/006; B41J 19/00; B41J 2/01; G03G 2215/00565; G03G 2215/00675; G03G 2215/00679
See application file for complete search history.

(56) References Cited

U.S. PATENT DOCUMENTS 6,000,775 A * 12/1999 Muraki ..... B41J 2/16511 347/30
6,286,931 B1 * 9/2001 Kawakami ..... B41J 2/16511 347/104
2011/0199430 A1 8/2011 Yajima et al.
2013/0076831 A1 * 3/2013 Ishida ..... B41J 2/16588 347/37

FOREIGN PATENT DOCUMENTS

JP 09-296820 A 11/1997
JP 2011-161859 A 8/2011
JP 2013-139121 A 7/2013
JP 2015-030103 A 2/2015

* cited by examiner

*Primary Examiner* — Kristal Feggins
(74) *Attorney, Agent, or Firm* — Workman Nydegger

(57) ABSTRACT

A liquid discharging apparatus including a fixed section; a movable section that is mounted to be displaceable with respect to the fixed section; a rail section which has a planar portion, in which a plane is formed in a reference direction, and in which the planar portion is fixed to the movable section; and a carriage on which a head that is able to discharge a liquid is mounted and which is mounted on the rail section to be movable in the reference direction, in which the movable section is displaced with respect to the fixed section so as to rotate the rail section about an axis extending in the reference direction.

10 Claims, 10 Drawing Sheets

LIQUID DISCHARGING APPARATUS AND METHOD OF ADJUSTING RAIL SECTION IN LIQUID DISCHARGING APPARATUS

BACKGROUND

1. Technical Field

The present invention relates to a liquid discharging apparatus and a method of adjusting a rail section in the liquid discharging apparatus.

2. Related Art

As a guide member for guiding reciprocation of a carriage of a liquid discharging apparatus, a round rod-shaped guide shaft as illustrated in JP-A-2011-161859 is a conventional mainstream shaft. Then, a guide mechanism having a configuration, in which a main guide shaft is provided in a lower portion of a guide mounting surface of a support frame and guides reciprocation of the carriage, and a sub-guide shaft is provided in an upper portion of the support frame and guides the reciprocation of the carriage in an auxiliary manner while regulating forward inclination of the carriage, is disclosed in JP-A-2011-161859.

However, as the liquid discharging apparatus becomes larger, the carriage also becomes large in size and much heavier. Therefore, in the guide mechanism having the configuration described above, the large sized carriage may not be compatible and there is a need to develop a guide mechanism having higher rigidity.

On the other hand, in a field of industrial machinery and equipment such as an X-Y table, as the guide mechanism having higher rigidity, a linear guide, in which a guide rail and a slide block are unitized, is widely used.

In general, the guide rail of the linear guide includes a bottom surface that is processed with high accuracy and a groove rail on which the slide block is movably mounted. The bottom surface is in contact with a robust support base having a guide mounting surface that is a plane having high accuracy so that the guide rail is mounted.

As the guide mechanism of the liquid discharging apparatus, if the linear guide, in which the plane is formed along a reference direction, is used, even if the large sized and heavy carriage is used, it is possible to stabilize the reciprocation of the carriage in the reference direction for a long period of time without the occurrence of inclination in the carriage.

However, if the linear guide is used, the inclination of the linear guide may occur in a direction in which the linear guide is rotated about an axis extending in the reference direction. Moreover, such a problem does not occur if a guide shaft of which a cross section is round (round rod shape) is used.

SUMMARY

An advantage of some aspects of the invention is to adjust an inclination of a linear guide about an axis extending in a reference direction in a case where the linear guide has a plane that is formed substantially in parallel with the reference direction.

According to an aspect of the invention, there is provided a liquid discharging apparatus including a fixed section; a movable section that is mounted to be displaceable with respect to the fixed section; a rail section which has a planar portion, the planar portion including a plane formed substantially in parallel with a reference direction, and the planar portion being fixed to the movable section; and a carriage, on which a head is mounted, mounted on the rail section to be reciprocated in the reference direction. The movable section is displaced with respect to the fixed section so as to rotate the rail section about an axis extending in the reference direction.

In this case, it is possible to adjust the inclination of the rail section in a rotation direction about an axis extending in the reference direction.

In the liquid discharging apparatus, it is preferable that the movable section rotates the rail section about an axis extending in the reference direction by being slid with respect to the fixed section.

In this case, it is possible to suitably adjust the inclination of the rail section by causing the movable section to slide.

In the liquid discharging apparatus, it is preferable that an adjusting section that causes the movable section to slide with respect to the fixed section in accordance with the rotation of a cam section by abutting against the cam section is further provided.

In this case, it is possible to suitably adjust the inclination of the rail section by rotating the cam section.

In the liquid discharging apparatus, it is preferable that a holding section that holds the movable section to be displaceable with respect to the fixed section is further provided and a plurality of holding sections are disposed with intervals in the reference direction.

In this case, it is possible to disperse a load with respect to the holding section by disposing the plurality of holding sections holding the movable section. In addition, it is possible to gently adjust the inclination of the rail section by providing the intervals between the holding sections.

In the liquid discharging apparatus, it is preferable that the number of the holding sections disposed in a first region that is a region on one side from a center of the movable section in the reference direction is greater than the number of the holding sections disposed in a second region that is a region on the other side from the center of the movable section in the reference direction.

In this case, during transportation of the liquid discharging apparatus, it is possible to receive a local load with respect to the movable section generated in a portion in which the carriage is positioned in a dispersed form by the holding sections which are more disposed than those of the other side by positioning the carriage in the first region in which the number of the holding sections is greater than that on the other side. In addition, it is possible to reduce the occurrence of damage such as deformation of a movable frame generated by the local load.

It is preferable that a stopper that is disposed in an end portion of the carriage on at least one side in the reference direction and is able to catch the carriage is further provided.

In this case, when the carriage reaches the end portion of a moving range of the carriage, it is possible to suppress moving of the carriage exceeding the moving range by the stopper.

In the liquid discharging apparatus, it is preferable that the adjusting section is configured of a member integral with the movable section.

In this case, as the adjusting section and the movable section are configured by the integral member, it is possible to achieve a reduction of the number of components and to improve productivity by reducing the number of assembly steps.

In the liquid discharging apparatus, it is preferable that the adjusting section is configured of a member separated from the movable section.

In this case, it is possible to adjust the number of the adjusting sections and the mounting position of each adjusting section in accordance with the length of the movable section in the reference direction and the like. Therefore, it is possible to correspond to various movable sections with different lengths in the reference direction and the like, and to improve versatility.

In the liquid discharging apparatus, it is preferable that the fixed section and the movable section are configured by an integral member.

In this case, as the fixed section and the movable section are configured by the integral member, it is possible to achieve a reduction of the number of components and to improve productivity by reducing the number of assembly steps.

According to another aspect of the invention, there is provided a method of adjusting a rail section in a liquid discharging apparatus including a fixed section, a movable section that is mounted to be displaceable with respect to the fixed section, a rail section which has a planar portion, the planar portion including a plane formed substantially in parallel with a reference direction, and the planar portion being fixed to the movable section, and a carriage, on which a head is mounted, mounted on the rail section to be reciprocated in the reference direction, the method of adjusting a rail section including displacing the movable section with respect to the fixed section so as to rotate the rail section about an axis extending in the reference direction.

In this case, it is possible to adjust the inclination of the rail section in the rotation direction about an axis extending in the reference direction.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, a liquid discharging apparatus 1 according to an embodiment of the invention will be described with reference to drawings. The liquid discharging apparatus 1 is specifically an ink jet printer.

In addition, in the following description, initially, a schematic configuration of a liquid discharging apparatus 1A according to Embodiment 1 will be described as an example of the liquid discharging apparatus of the invention. Next, a specific configuration of the liquid discharging apparatus that is a feature configuration of the invention will be described.

Subsequently, a configuration of each of liquid discharging apparatuses (1B and 1C) according to Embodiment 2 and Embodiment 3 of which a part of configurations is different from that of Embodiment 1 will be described specifically focusing on differences from Embodiment 1. Furthermore, a method of adjusting an angle of a guide mounting surface in the liquid discharging apparatus according to the embodiment of the invention will be described in accordance with an operation procedure of a case where the liquid discharging apparatus 1A according to Embodiment 1 is used as an example.

Embodiment 1 (See FIGS. 1 to 7)

Figure 1:
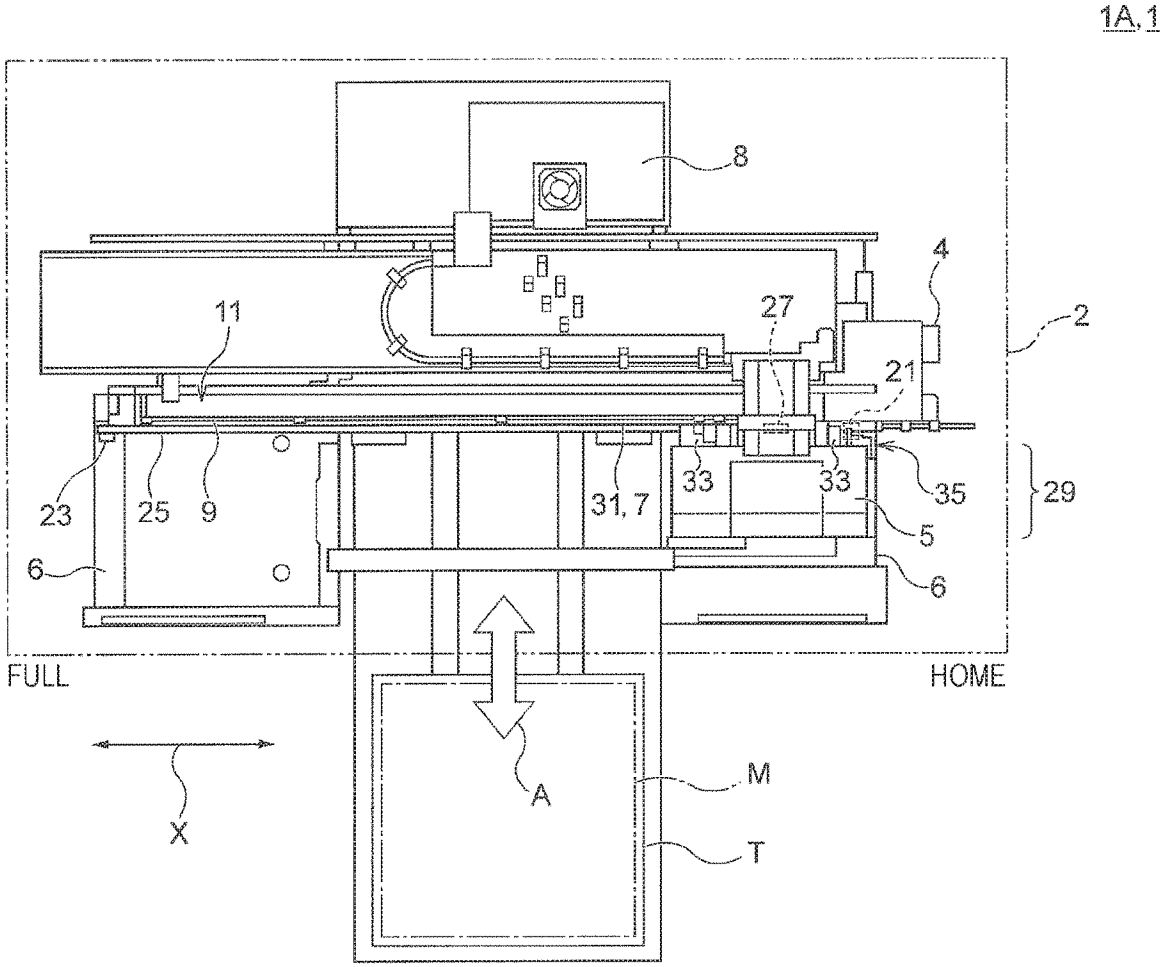
FIG. 1 is a plan view illustrating an outline of a liquid discharging apparatus according to Embodiment 1 of the invention.
Figure 2:
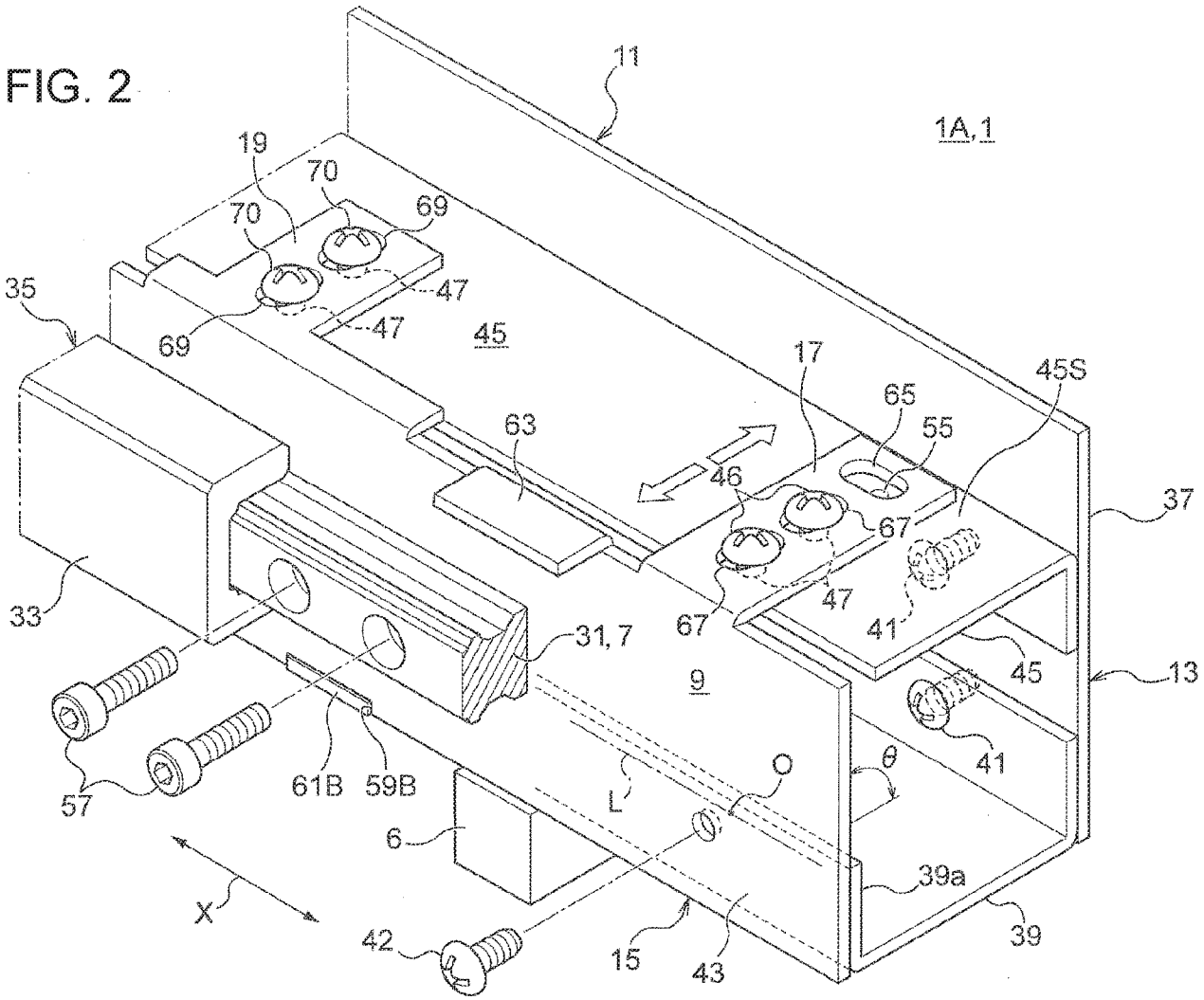
FIG. 2 is a perspective view illustrating a main portion of the liquid discharging apparatus according to Embodiment 1 of the invention.
Figure 3:
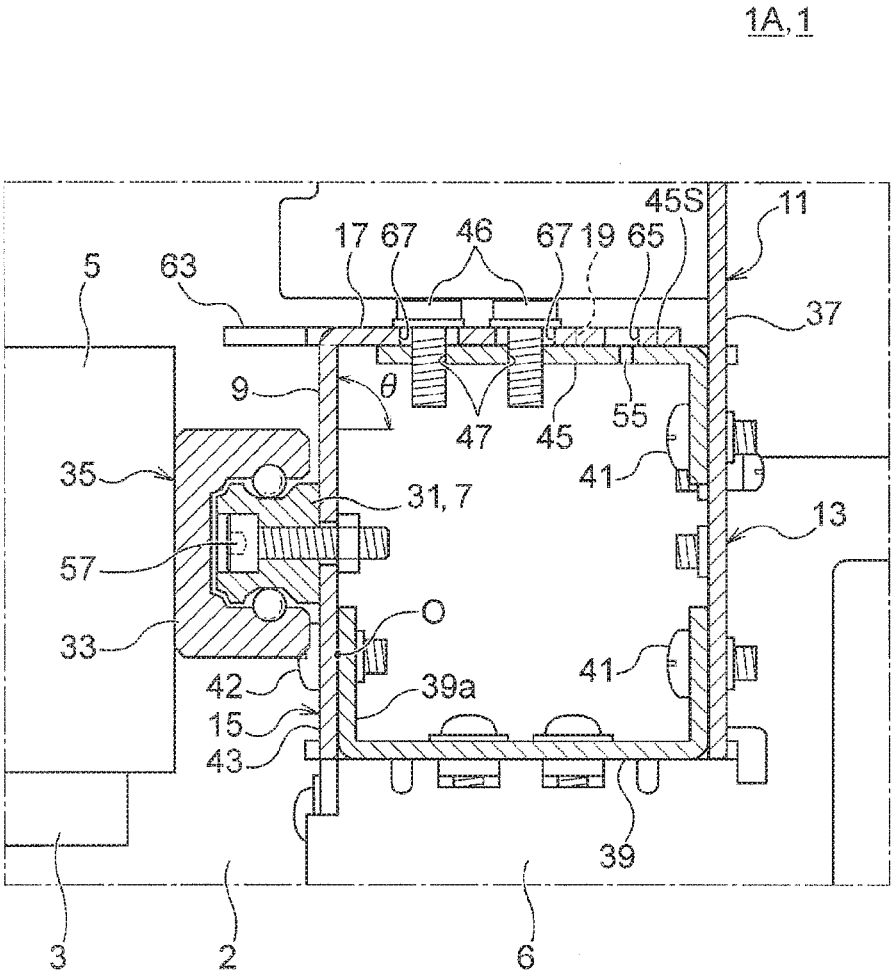
FIG. 3 is a side sectional view illustrating a main portion of the liquid discharging apparatus according to Embodiment 1 of the invention.

(1) Schematic Configuration of Liquid Discharging Apparatus (See FIGS. 1 to 3)

As illustrated in FIG. 1, the liquid discharging apparatus 1A according to the embodiment is a large serial type ink jet printing apparatus intended for printing on fabric such as T-shirt that is set on a tray T as a medium M. Then, the liquid discharging apparatus 1A includes a carriage 5 having a relatively large size and heavy weight on which a head 3 (FIG. 3) is mounted and which reciprocates in a reference direction X that is a scanning direction, a guide member 7 that guides the reciprocation of the carriage 5, and a support frame 11 that has a guide mounting surface 9 on which the guide member 7 is mounted. The guide member 7 may be also referred to as a rail section extending in the reference direction X. The rail section has a planar portion in which a plane (reference surface) is formed in the reference direction X. Then, the planar portion of the rail section is mounted on the guide mounting surface 9. In other words, the planar portion is a surface mounted on the guide mounting surface 9 in the rail section.

In addition, the carriage 5, the guide member 7, and the support frame 11 are housed in a housing 2 indicated a phantom line in FIG. 1. A carriage motor 4 that is a driving unit for reciprocating the carriage 5 and a traveling belt 25 that is driven by receiving rotation of an output shaft of the carriage motor 4, is wound between a driving pulley 21 and a driven pulley 23, and is configured of an endless strip toothed belt are included in the housing 2. The traveling belt 25 is an example of a transmitting section for transmitting a driving force of the driving unit to the carriage 5. In addition, a locking section 27 for locking the carriage 5 is provided in a part of the traveling belt 25, a traveling operation of the traveling belt 25 in the reference direction X is transmitted to the carriage 5 via the locking section 27, and thereby the carriage 5 can reciprocate in a predetermined moving range necessary for recording the medium M.

In addition, in the following description, a right end side of the moving range of the carriage 5 in FIG. 1 is defined as a Home side and a left end side in FIG. 1 is defined as a Full side. In addition, in FIG. 1, an arrow pointing both directions in a center lower portion indicates a transporting direction A of the medium M. The transporting direction A is a direction including a direction of guiding the medium M to a recording execution region 29 in the housing 2 and a direction of discharging the medium M to an outside of the housing 2 after the recording is executed.

Here, the term "fabric" means fiber products such as cloth and textile of which original threads are cotton, hump, silk, or materials obtained by mixing thereof. For example, fiber products such as broadcloth and sheeting used for a material of clothing such as blouse, shirt, and work clothes are included. In addition, rayon, cupra, polynosic, acetate, triacetate, promix, nylon, polyester, acrylic, polyvinyl chloride, and polyurethane of chemical fibers may be included. Coated paper of which a surface is coated, a film of which a back surface is released, rayon, synthetic paper, and the like can be also used.

In addition, in the embodiment, a guide rail 31 is employed as the guide member 7. The guide rail 31 is unitized with a slide block 33 reciprocating in a longitudinal direction of the guide rail 31 by engaging with the guide rail 31 and constitutes a guide mechanism with a linear guide 35. The slide block 33 is integral with the carriage 5 by mounting the carriage 5 on the slide block 33 and thereby the carriage 5 is configured to reciprocate in the reference direction X. In summary, the head 3 that is able to discharge a liquid is mounted on the carriage 5 and the carriage 5 is mounted on the rail section to be movable in the reference direction X. In addition, as the linear guide 35, various linear guides which are commercially available as machine components may be used.

In addition, as illustrated in FIGS. 2 and 3, the support frame 11 is supported on a plurality of portions including near both ends in the reference direction X by a side frame 6 having rigidity which is mounted on the inside of the housing 2 in a fixed stated.

(2) Specific Configuration of Liquid Discharging Apparatus (See FIGS. 3 to 7)

The liquid discharging apparatus 1A according to the embodiment has features in the configuration of the support frame 11. Specifically, the support frame 11 is basically configured to include a fixed frame 13 that is mounted on the housing 2 of the liquid discharging apparatus 1A via the side frame 6 in the fixed stated, a movable frame 15 that is connected to the fixed frame 13 to be displaceable in a direction in which an angle θ of the guide mounting surface 9 is adjusted via a connection point O, and an adjusting plate 17 that is an adjusting section for adjusting a position of the movable frame 15 with respect to the fixed frame 13. In this case, the fixed frame 13 can be said to be the fixed section mounted in the fixed state. In addition, the movable frame 15 can be said to be the movable section mounted on the fixed section to be displaceable.

In addition, in the embodiment, a plurality of holding plates 19 for fixing a position of the movable frame 15 with respect to the fixed frame 13 are provided in the support frame 11 with intervals in the reference direction X.

The fixed frame 13 is a member that is formed by connecting a rear plate 37 that is a rectangular plate elongated in the reference direction X and a bottom plate 39 having a grooved cross section elongated in the reference direction X with screws 41. The fixed frame 13 is specifically made of metal, but may be formed of other materials. Then, a rear surface of the rear plate 37 and a bottom surface of the bottom plate 39 are integrally supported and fixed with the housing 2 via the side frame 6 described above.

In addition, a fixed plate 45 having an L shape cross section elongated in the reference direction X is mounted on the rear plate 37 in an eaves shape so as to project forward from a front surface of the rear plate 37 using mounting screws 41. In addition, in the fixed plate 45, a plurality of screw holes 47 for mounting the adjusting plates 17 and the holding plates 19 described below, and a plurality of fitting holes 55 in which an insertion section 53 of an eccentric driver 49 described below is inserted are provided in positions respectively corresponding to positions in which the adjusting plates 17 and the holding plates 19 are provided. An upper surface of the fixed plate 45 is a slide surface 45S (FIG. 2) on which the adjusting plates 17 slide.

The movable frame 15 is configured of a metal front plate 43 of a rectangular plate shape that is elongated in the reference direction X and has a height lower than that of the rear plate 37. The metal front plate 43 is an example and other shapes and elements may be used. The front plate 43 is mounted on a raised section 39*a* provided on a front side of the bottom plate 39 using mounting screws 42.

In addition, the front surface of the front plate 43 is the guide mounting surface 9 on which the guide member 7 is mounted and the guide rail 31 described above is mounted on the guide mounting surface 9, of which a longitudinal direction is the reference direction X, using mounting crews 57. In other words, the planar portion of the rail section is fixed to the movable section.

In addition, an engaging concave portion 59B is formed in an appropriate position in a lower end edge of the front plate 43. An engaging convex portion 61B projecting on the front side in the eaves shape, which is formed by cutting a part of the raised section 39*a* in the bottom plate 39 of the fixed frame 13 described above, is configured to be engaged with the engaging concave portion 59B.

Then, the movable frame 15 having such a configuration is configured so as to be rotated back and forth of which a portion connected to the fixed frame 13 by the mounting screws 42 is the connection point O and an axis extending in the reference direction X through the connection point O is a rotation axis L. That is, the movable section is displaced with respect to the fixed section so as to rotate the rail section about an axis extending in the reference direction X. Therefore, it is possible to adjust inclination of the rail section in a rotation direction about an axis extending in the reference direction X. Therefore, even if the inclination of the rail section occurs in the direction in which the rail section is rotated about an axis extending in the reference direction X, it is possible to make suitable the angle of the rail section by appropriately adjusting the inclination of the rail section. Thus, it is possible to suppress the inclination of the rail section in the rotation direction about an axis extending in the reference direction X.

The adjusting plate 17 is a member that is connected to an upper end edge that is a rotation free end of the movable frame 15 that is rotated around the rotation axis L that is the axis in the direction along the reference direction X via the connection point O with the fixed frame 13 and slides back and forth along the slide surface 45S provided in the fixed plate 45 configuring the fixed frame 13 described above.

Figure 4:
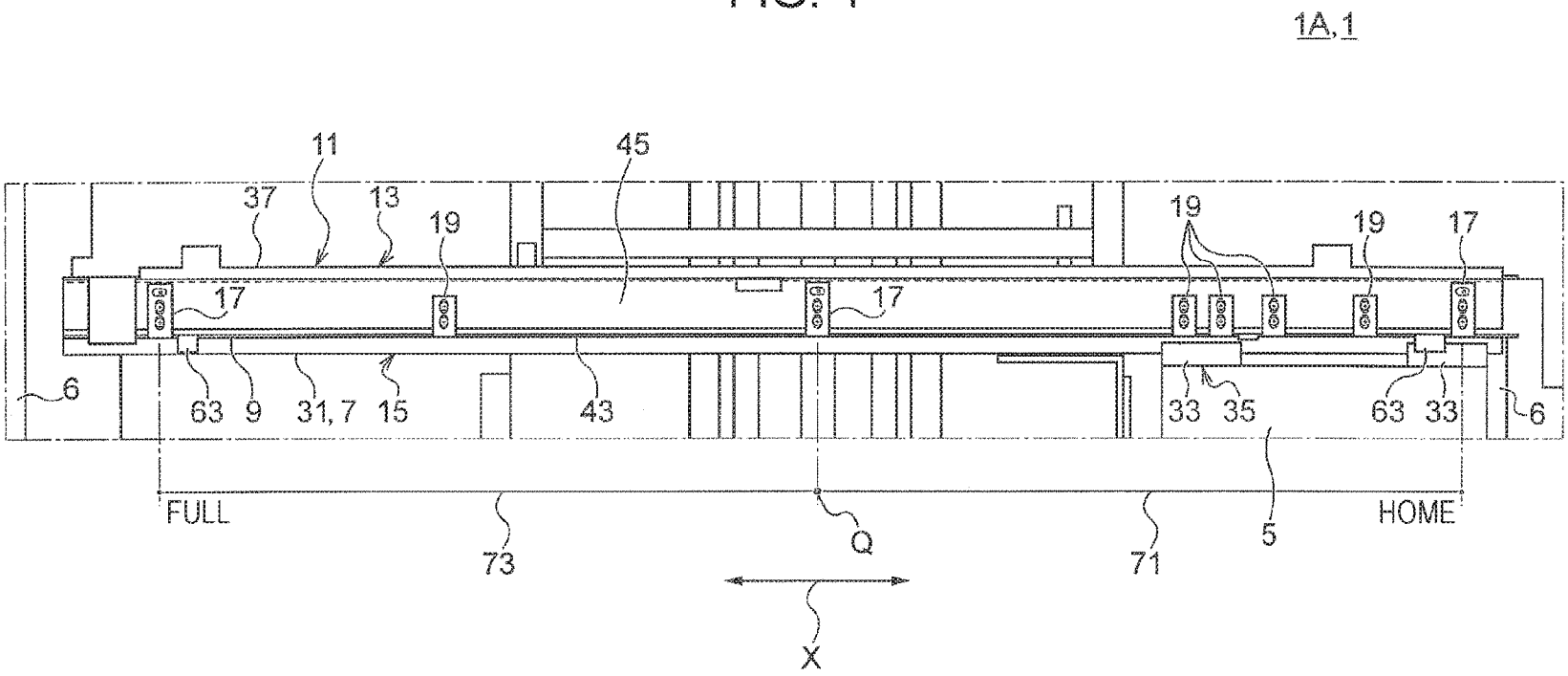
FIG. 4 is a plan view illustrating a main portion of the liquid discharging apparatus according to Embodiment 1 of the invention.

In addition, as illustrated in FIG. 4, the adjusting plates 17 of the embodiment are provided in three portions of near both ends and a center in the reference direction X. Then, the angle θ of the guide mounting surface 9 provided in the movable frame 15 can be adjusted by individually changing the mounting positions of the adjusting plates 17, which are provided in three portions, with respect to the fixed plate 45. That is, the movable section rotates the rail section about an axis extending in the reference direction X by being slid with respect to the fixed section. Therefore, it is possible to appropriately adjust the inclination of the rail section by sliding the movable section.

Moreover, the three portions in which the adjusting plates 17 are provided are an example and the adjusting plates 17 may be provided in other positions. In addition, the adjusting plates 17 may be provided in four or more portions or provided in one to two portions.

Figure 6:
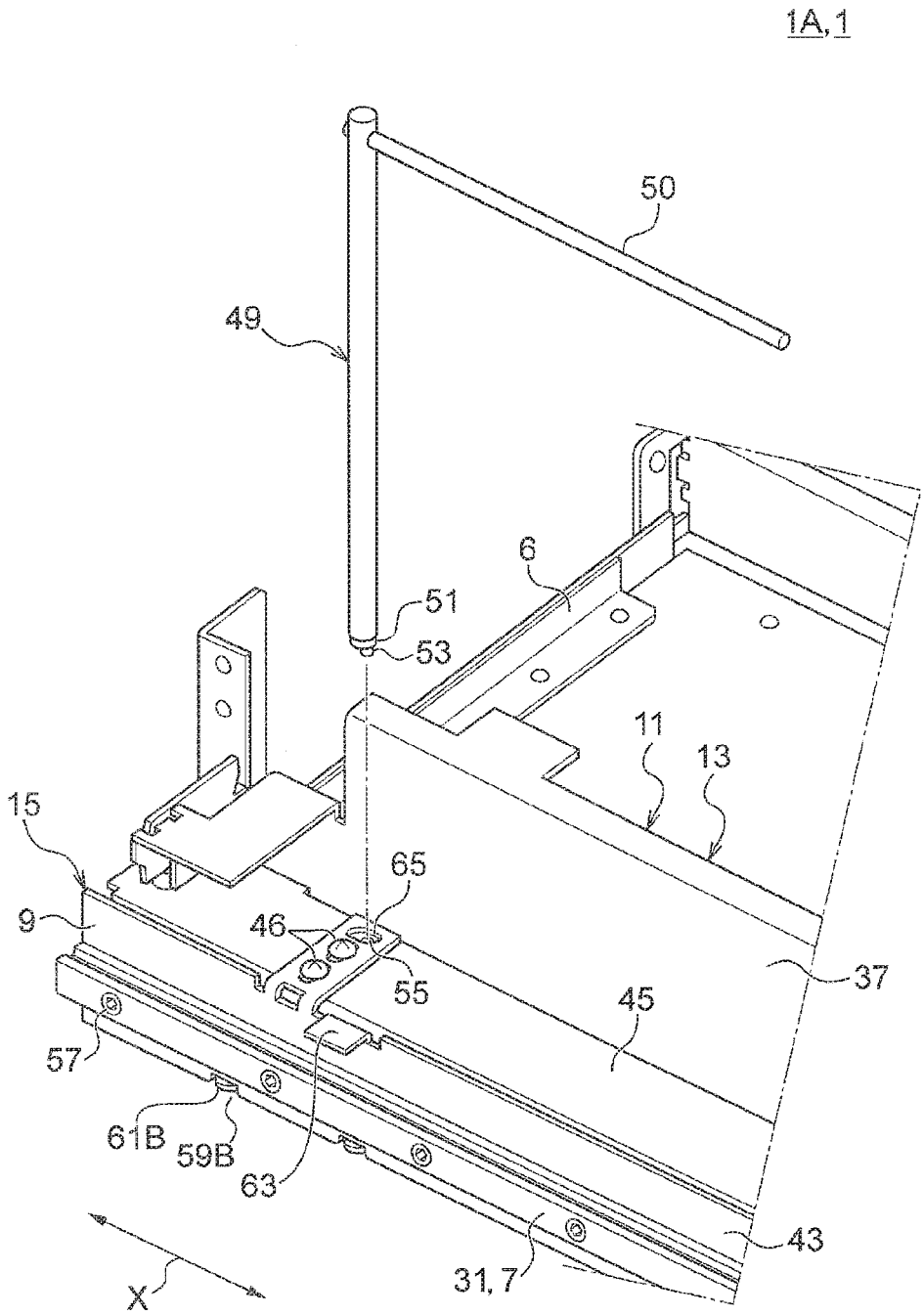
FIG. 6 is an exploded perspective view illustrating a manner of an adjusting operation of a mounting position of an adjusting section in the liquid discharging apparatus according to Embodiment 1 of the invention.
Figure 7:
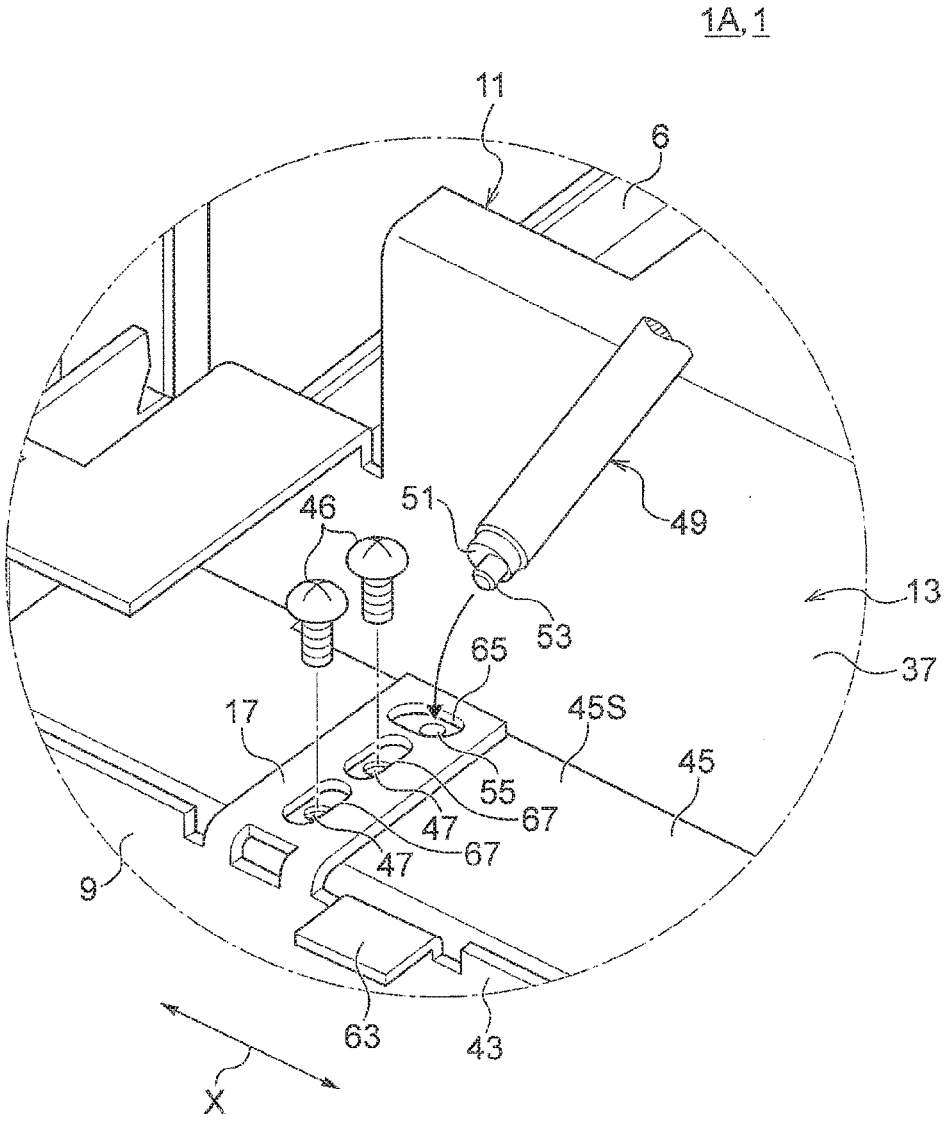
FIG. 7 is an enlarged exploded perspective view illustrating a manner of the adjusting operation of the mounting position of the adjusting section in the liquid discharging apparatus according to Embodiment 1 of the invention.

The eccentric driver 49 used for displacing the adjusting plates 17 includes an abutting shaft 51 and the insertion section 53. The abutting shaft 51 and the insertion section 53 correspond to a cam section that is eccentrically rotated. In addition, an adjusting long hole 65 that is engaged with the abutting shaft 51 provided in a tip of the shaft portion of the eccentric driver 49 as illustrated in FIGS. 6 and 7, and extends in the reference direction X, and two mounting long holes 67 that extend in a sliding direction of the adjusting plate 17 are formed in the adjusting plate 17. Moreover, the mounting long holes 67 may be three or more or may be one.

On the other hand, on the slide surface 45S of the fixed plate 45, the fitting hole 55, which fits to the insertion section 53 provided in a position eccentric to the abutting shaft 51 of the tip of the abutting shaft 51 of the eccentric driver 49, is provided in a position corresponding to the adjusting long hole 65 described above. The screw holes 47 for mounting screws 46 are provided in positions corresponding to the mounting long holes 67 described above.

Then, in a case where the adjustment of the angle θ of the guide mounting surface 9 is performed, in a state where the abutting shaft 51 is engaged with the adjusting long hole 65 and the insertion section 53 is fitted into the fitting hole 55, the eccentric driver 49 is rotated in a predetermined direction by a predetermined amount by the insertion section 53 as a fulcrum using the handle 50. Therefore, the adjusting plate 17 slides back and forth by a predetermined amount by the cam operation of the eccentric driver 49 and thereby can perform the position adjustment. In summary, the liquid discharging apparatus 1A includes an adjusting section that causes the movable section to slide with respect to the fixed section in accordance with the rotation of the cam section by abutting against the cam section. Then, it is possible to appropriately adjust the inclination of the rail section by rotating the cam section.

In addition, the adjusting plate 17 is fixed to the fixed plate 45 using the mounting screws 46 after the position adjustment of the adjusting plate 17. Then, in the embodiment, the adjusting plate 17 is configured of a member integral with the movable frame 15 described above. In other words, the adjusting section is configured of a member integral with the movable section. Therefore, as the adjusting section and the movable section are configured by an integral member, it is possible to achieve reduction of the number of components and to improve productivity by reducing the number of assembly steps.

As described above, the liquid discharging apparatus 1A includes the holding section that holds the movable section to be displaceable with respect to the fixed section. Then, a plurality of holding sections are disposed with intervals in the reference direction X. The plurality of holding sections for holding the movable section are disposed and thereby it is possible to disperse a load with respect to the holding sections. In addition, it is possible to gently adjust inclination of the rail section by providing the intervals between the holing sections.

In the holding plate 19 as a specific example of the holding section, similar to the adjusting plate 17 described above, mounting long holes 69 extending the forward and rearward direction that is a displacing direction of the movable frame 15 are provided by two. In addition, the adjusting long hole 65 provided in the adjusting plate 17 is not provided in the holding plate 19.

Then, fixing screws 70 are mounted on the screw holes 47 formed in the slide surface 45S of the fixed plate 45 by passing through the mounting long holes 69 provided in the holding plate 19. Therefore, it is possible to correspond to the shift of the displacement of the movable frame 15 for each holding plate 19 in a length range of the mounting long hole 69.

In addition, as illustrated in FIG. 4, a region of one side (here, Home side) from a center Q in the reference direction X of the movable frame 15 is defined as a first region 71 and a region of the other side (here, Full side) from the center Q in the reference direction X of the movable frame 15 is defined as a second region 73. In this case, in the embodiment, the holding plates 19 are disposed such that the number of the holding plates 19 positioned in the first region 71 is greater than the number of the holding plates 19 positioned in the second region 73. Specifically, the number of the holding plates 19 included in the first region 71 is four and the number of the holding plates 19 included in the second region 73 is one.

In a state where the carriage 5 positioned in the first region 71 during being unused applies a load to generate the inclination in the movable frame 15 by vibration or impact during transportation, the load is effectively absorbed by the many disposed holding plates 19 and it is possible to suppress occurrence of the inclination of the movable frame 15 by employing such disposition of the holding plates 19.

In summary, in the liquid discharging apparatus 1A, the number of the holding sections disposed in the first region 71 that is the one side region from the center of the movable section in the reference direction X is greater than the number of the holding sections disposed in the second region 73 that is the other side region from the center of the movable section in the reference direction X. Therefore, during transportation of the liquid discharging apparatus 1A, it is possible to receive a local load with respect to the movable section generated in a portion in which the carriage 5 is positioned in a dispersed form by the many disposed holing sections by positioning the carriage 5 in the first region 71 in which the number of the holing sections is greater than that on the other side. In addition, it is possible to reduce occurrence of damage such as deformation of the movable frame 15 generated by the local load.

In addition, a stopper 63 that sets a moving end of the carriage 5 in the moving direction is provided near the adjusting plate 17 disposed at least one end of the moving range of the carriage 5.

Figure 5:
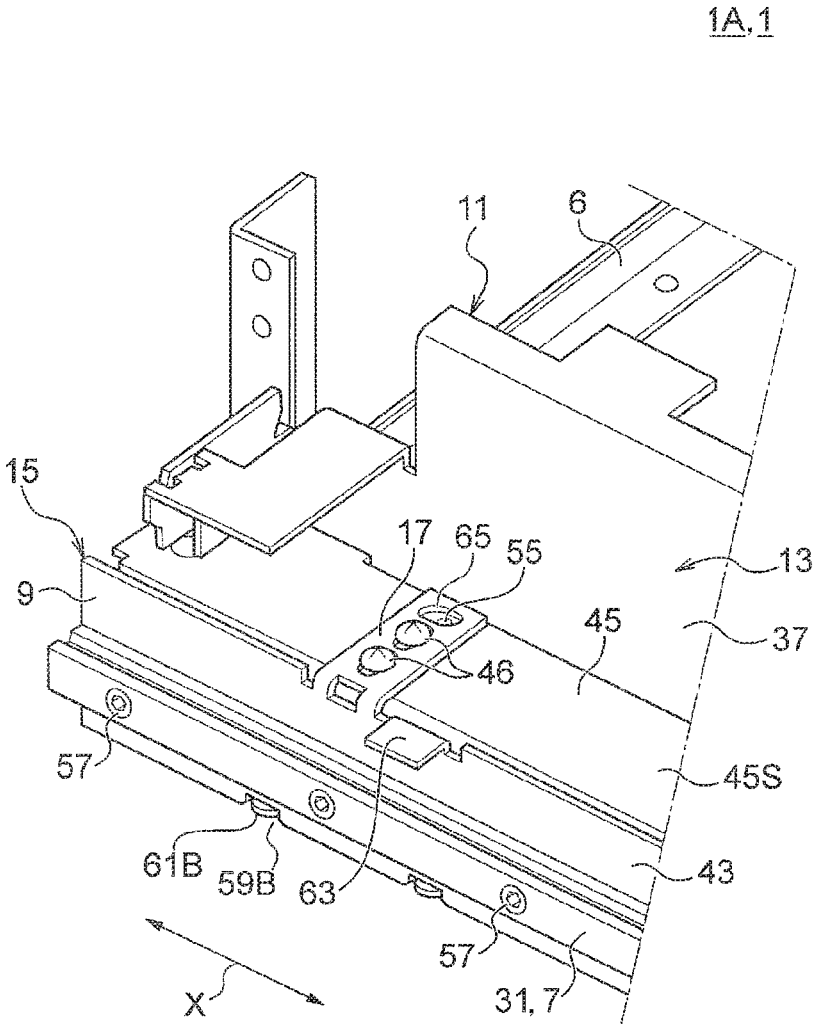
FIG. 5 is a perspective view illustrating a stopper on one end side (Full side) of the liquid discharging apparatus according to Embodiment 1 of the invention.

In the embodiment, as illustrated in FIGS. 2 and 5, the rectangular plate-shaped stoppers 63 projecting on the front side in the eaves shape are provided in two adjusting plates 17 disposed on both ends of the Home side and the Full side of the moving range of the carriage 5. That is, the liquid discharging apparatus 1A includes the stopper 63 that is disposed in at least one side end portion of the carriage 5 in the reference direction X and is able to catch the carriage 5. Therefore, when the carriage 5 reaches the end portion of the moving range of the carriage 5, it is possible to suppress moving of the carriage 5 exceeding the moving range by the stopper 63.

A summary of the embodiment is as follows. The liquid discharging apparatus 1A includes the carriage 5 on which the head 3 is mounted and which reciprocates in the reference direction X that is the scanning direction, the guide member 7 that guides the reciprocation of the carriage 5, and the support frame 11 that has the guide mounting surface 9 on which the guide member 7 is mounted. The support frame 11 includes the fixed frame 13 and the movable frame 15 that is connected to the fixed frame 13 to be displaceable in the direction in which the angle of the guide mounting surface 9 is adjusted. Therefore, the support frame 11 having the guide mounting surface 9 for mounting the guide member 7 which guides the reciprocation of the carriage 5 includes the fixed frame 13 and the movable frame 15 that is connected to the fixed frame 13 to be displaceable in the direction in which the angle of the guide mounting surface 9 is adjusted. Therefore, the angle adjustment of the guide mounting surface 9 is performed by displacing the movable frame 15 with respect to the fixed frame 13. Thus, it is possible to easily adjust the angle of the guide mounting surface 9 to an appropriate angle by the displacing operation. Therefore, in a case where a linear guide and the like are used as the guide member 7 of the carriage 5, even if the support frame 11 which requires a high-precision plane for mounting the guide member 7 is configured of sheet metal, it is possible to easily form the high-precision plane. That is, it is possible to easily form the high-precision plane on which the guide member 7 is mounted without using heavy and expensive rigid support base.

In addition, the liquid discharging apparatus 1A includes the adjusting section that adjusts the position of the movable frame 15 with respect to the fixed frame 13. The movable frame 15 is able to be rotated about the reference direction X as the rotation axis via the connection point with the fixed frame 13. The adjusting section is provided in a movable free end of the rotatable the movable frame 15 which is able to be rotated, slides along the slide surface 45S provided in the fixed frame 13, changes the mounting position on the slide surface 45S, and thereby adjusts the angle of the guide mounting surface 9. Therefore, the adjusting section that adjusts the position of the movable frame 15 with respect to the fixed frame 13 is provided, the movable frame 15 is able to be rotated in the direction of the reference direction X as the rotation axis via the connection point with the fixed frame 13. Therefore, it is possible to rotate the movable frame 15 by changing the mounting portion of the adjusting section with respect to the fixed frame 13. Therefore, it is possible to perform the angle adjustment of the guide mounting surface 9. In addition, it is possible to adjust the angle of the guide mounting surface 9 to a predetermined angle only by the sliding operation of the adjusting section.

In addition, in a case where the inclination occurs in the guide mounting surface 9 with elapse of time by being used for a long period time, the fixing members such as the mounting screws 46 for fixing the adjusting section are loosened once, the mounting portion of the adjusting section is adjusted again, and then it is possible to easily adjust again the angle of the guide mounting surface 9 to an appropriate angle by fixing with the fixing member again. Therefore, the angle of the guide mounting surface 9 can be always and easily held in an appropriate value. Furthermore, even if a large and heavy carriage 5 is used, it is possible to always and stably perform high-precision recording while maintaining a posture of the carriage 5 in a good posture.

In addition, the adjusting long hole 65 extending in the reference direction X engaging with the abutting shaft 51 of the eccentric driver 49 is provided in the adjusting section. The fitting hole 55 fitting to the insertion section 53 of the eccentric driver 49 provided in a position eccentric to the abutting shaft 51 is provided in a position corresponding to the adjusting long hole 65 in the slide surface 45S. In a state where the abutting shaft 51 is engaged with the adjusting long hole 65 and the insertion section 53 is fitted into the fitting hole 55, the position adjustment of the adjusting section in the sliding direction is performed by rotating the eccentric driver 49 by the insertion section 53 as the fulcrum. Thus, in a state where the abutting shaft 51 of the eccentric driver 49 is fitted into the adjusting long hole 65 provided in the adjusting section and the insertion section 53 of the eccentric driver 49 is fitted into the fitting hole 55 provided in the slide surface 45S, it is possible to slide the adjusting section in a predetermined direction with a predetermined amount determined by the rotating direction, a rotation amount thereof, an eccentric amount between the abutting shaft 51 and the insertion section 53 by the cam operation due to the rotation of the eccentric driver 49.

In addition, a plurality of the holding sections of the movable frame 15 for fixing the position with respect to the fixed frame 13 are provided in the support frame 11 with intervals in the reference direction X. the mounting long holes 69 extending the displacing direction of the movable frame 15 is provided in the holding sections. The screw holes 47 are provided in positions corresponding to the mounting long holes 69 in the slide surface 45S provided in the fixed frame 13. Fixing screws are mounted on the screw holes 47 passing through the mounting long holes 69. Therefore, it is possible to disperse the load acting on the movable frame 15 by the plurality of holding sections and to increase the rigidity of the entire support frame 11. In addition, it is possible to gently adjust the inclination of the movable frame 15 by disposing the plurality of holding sections with the intervals.

In addition, it is possible to correspond to the shift of the displacement of the movable frame 15 for each holding section in a long range of the mounting long hole 69 by providing the mounting long hole 69 extending in the displacing direction of the movable frame 15 with respect to the holding plate.

In addition, the holding sections are disposed such a manner that the number of the holding sections in the first region 71 of one side from the center of the movable frame 15 in the reference direction X is greater than the number of the holding sections in the second region 73 of the other side from the center. Therefore, during transportation of the liquid discharging apparatus 1A, it is possible to receive a local load with respect to the movable frame 15 generated in a portion in which the carriage 5 is positioned in a dispersed form by the many disposed holing sections by positioning the carriage 5 in the first region 71 in which the number of the holing sections is greater than that on the other side. In addition, it is possible to reduce occurrence of damage such as deformation of the movable frame 15 generated by the local load.

Then, in general, since the carriage 5 is positioned in the home position on the Home side during being unused, it is preferable that the first region 71 is set in the region of the Home side from the center in the reference direction X of the movable frame 15.

In addition, the stopper 63 that sets the moving end of the carriage 5 in the moving direction is provided at least one end of the moving range of the carriage 5. Therefore, when the carriage 5 reaches the end portion of the moving range of the carriage 5, it is possible to suppress occurrence of a situation in which the carriage 5 is reciprocated exceeding the moving range by the stopper 63.

Then, a function as the stopper 63 for determining the moving range of the carriage 5 is formed by using the same configuration member as the adjusting section that is the configuration member of the support frame 11 that supports the carriage 5 and the guide member 7. Therefore, as a separate stopper 63 is not required to be provided, it is possible to achieve reduction of the number of components.

In addition, the adjusting section is configured of a member integral with the movable frame 15. Therefore, as the adjusting section and the movable frame 15 are configured by an integral member, it is possible to achieve reduction of the number of components. As the mounting operation of the adjusting section and the movable frame 15 which is performed by using mounting screws and the like is not required, it is possible to improve productivity by reducing the number of assembly steps.

Figure 8:
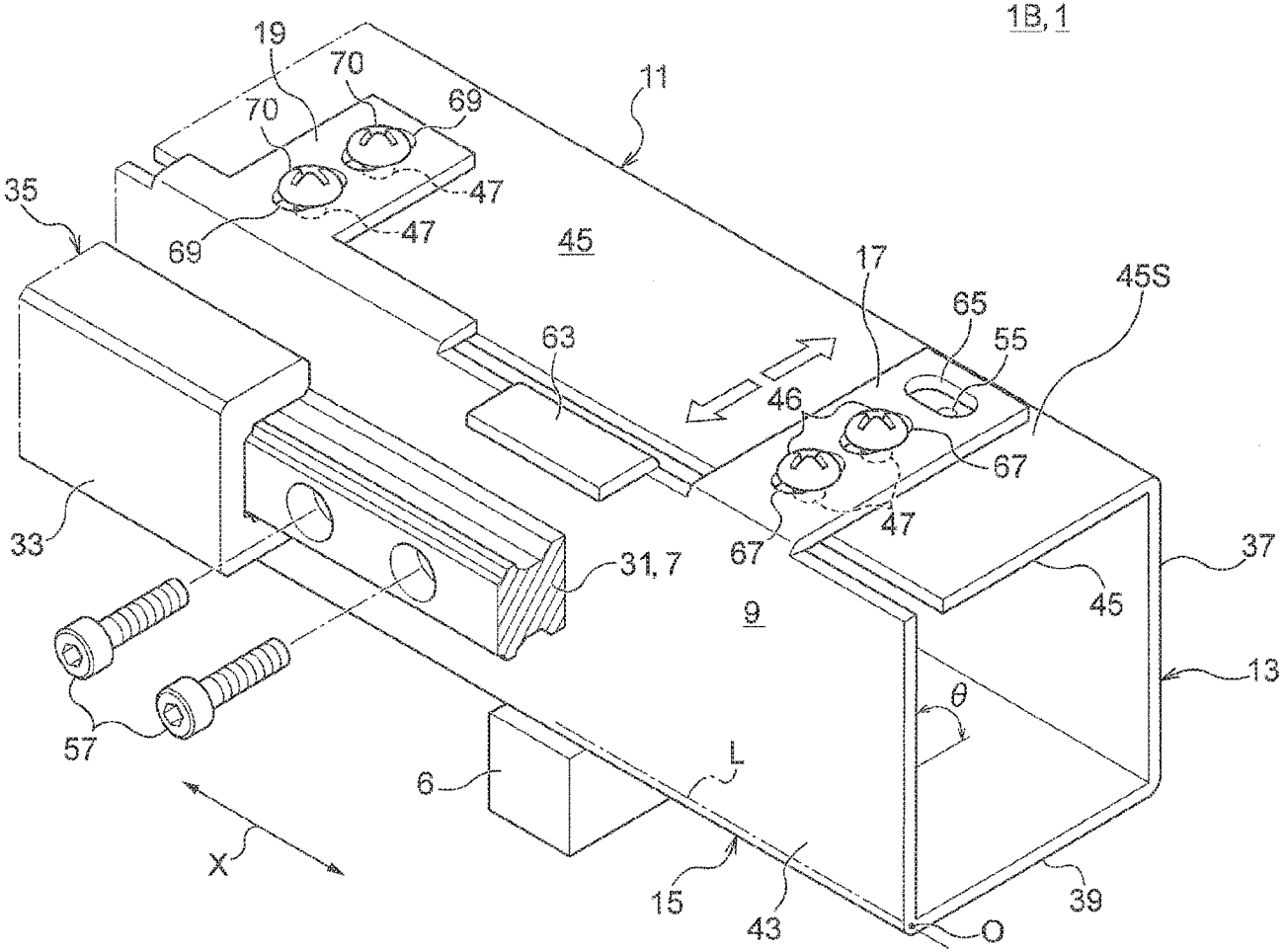
FIG. 8 is a perspective view illustrating a main portion of a liquid discharging apparatus according to Embodiment 2 of the invention.

Embodiment 2 (See FIG. 8)

Only a structure of a support frame 11 of a liquid discharging apparatus 1B according to the embodiment is somewhat different from the liquid discharging apparatus 1A of Embodiment 1 described above and the other configurations are the same as those of Embodiment 1. Therefore, the description of the same configuration as Embodiment 1 described above will be omitted here and the structure of the support frame 11 different from that of Embodiment 1 will be described.

That is, in the embodiment, a fixed frame 13 and a movable frame 15 are configured by an integral member. Specifically, the fixed frame 13 is configured by a member having a U-shaped cross section which is long in a reference direction X in which a fixed plate 45, a rear plate 37, and a bottom plate 39 are configured by an integral member.

Furthermore, a front plate 43 of a movable frame 15 is provided in a front end edge of the bottom plate 39 in a state where a lower end edge thereof is connected to the bottom plate 39 of the fixed frame 13 by the integral member. Each of an adjusting plate 17 and a holding plate 19 is provided in an upper end edge of the front plate 43 in a state where front end edges thereof are connected to the front plate 43 by the integral member.

In the embodiment, the rectangular tube-shaped support frame 11 is formed by bending a plate material punched into a predetermined shape in which the front plate 43, the bottom plate 39, the rear plate 37, and the fixed plate 45 are respectively disposed in a front surface, a bottom surface, a rear surface, and a top surface. Furthermore, the support frame 11 is provided having a configuration in which the adjusting plate 17 and the holding plate 19 are positioned so as to be overlapped on the fixed plate 45.

In addition, in a case where the support frame 11 having such a configuration is used, a corner portion of the front lower end in which the front plate 43 and the bottom plate 39 are connected is a connection point O. Similar to Embodiment 1 described above, the movable frame 15 is rotated around a rotational axis L extending in the reference direction X through the connection point O.

It is also possible to exhibit the same operations and effects as those of the liquid discharging apparatus 1A according to Embodiment 1 described above by the liquid discharging apparatus 1B according to the embodiment having such a configuration. Furthermore, in the embodiment, it is possible to omit the connection between the rear plate 37 and the bottom plate 39 and the connection between the rear plate 37 and the fixed plate 45 which are performed by using the mounting screws 41 required in Embodiment 1 described above. It is possible to omit the connection between the front plate 43 and the bottom plate 39 which is performed by using the mounting screws 42. Therefore, it is possible to reduce assembly costs by reducing the assembly steps of the support frame 11.

In summary, in the liquid discharging apparatus 1B, the fixed frame 13 and the movable frame 15 are configured by the integral member. Therefore, as the fixed frame 13 and the movable frame 15 are configured by the integral member, it is possible to achieve the reduction of the number of the components. The mounting operation of the fixed frame 13 and the movable frame 15 which is performed by using the mounting screws and the like is not required and thereby it is possible to improve productivity by reducing the number of assembly steps. In addition, the fixed frame 13 and the movable frame 15 are configured by the integral member and thereby the rigidity of the support frame 11 is increased.

In other words, in the liquid discharging apparatus 1B, the fixed section and the movable section are configured by the integral member. Therefore, as the fixed section and the movable section are configured by the integral member, it is possible to achieve reduction of the number of components and to improve productivity by reducing the number of assembly steps.

Figure 9:
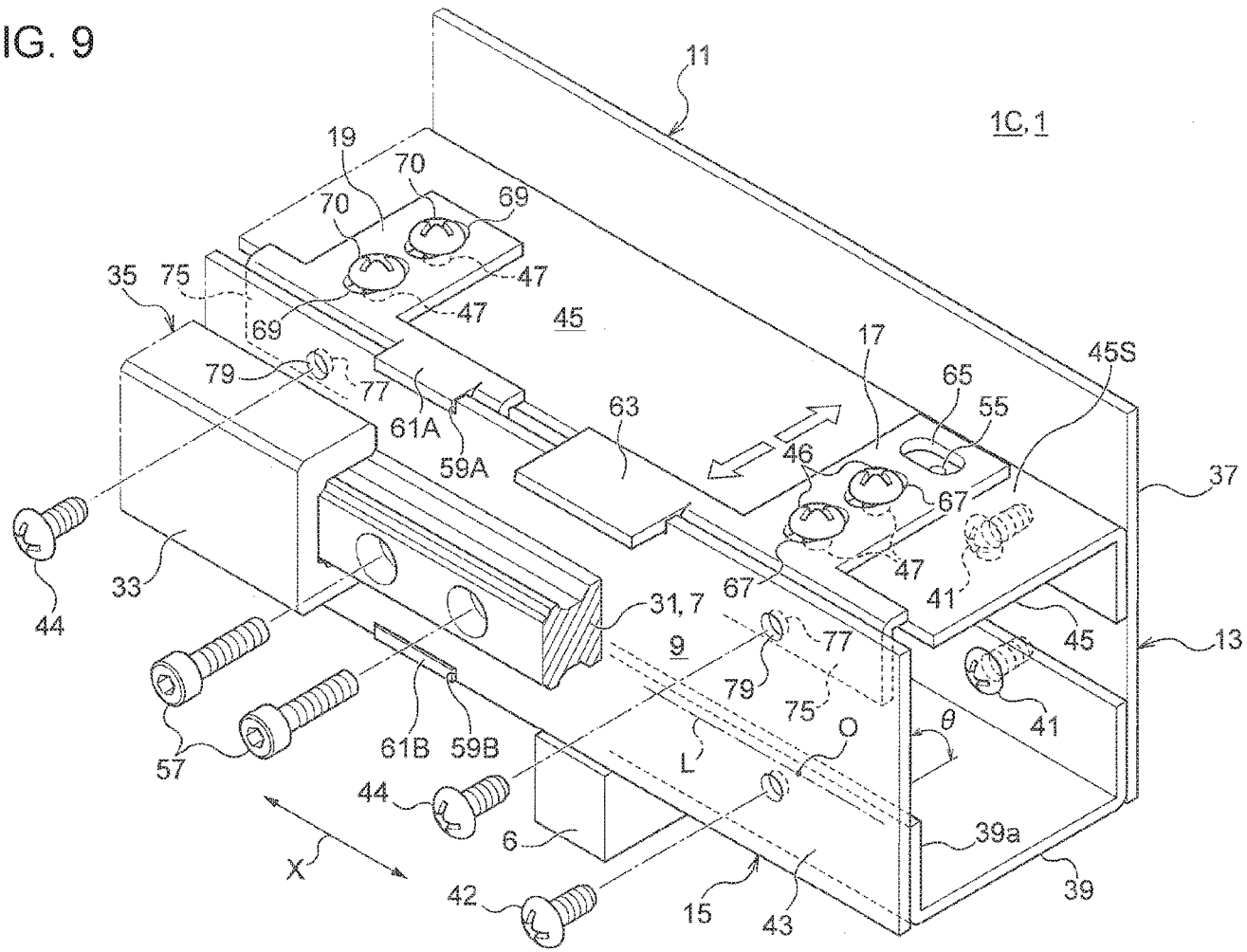
FIG. 9 is a perspective view illustrating a main portion of a liquid discharging apparatus according to Embodiment 3 of the invention.

Embodiment 3 (See FIG. 9)

Only a connection structure of an adjusting plate 17 and a holding plate 19 with respect to a movable frame 15 of a liquid discharging apparatus 1C according to the embodiment is different from that of the liquid discharging apparatus 1A according to Embodiment 1 described above and the other configurations are the same as those of Embodiment 1. Therefore, the description of the same configuration as Embodiment 1 described above will be omitted here and the connection structure of the adjusting plate 17 and the holding plate 19 with respect to the movable frame 15 different from that of Embodiment 1 will be described.

That is, in the embodiment, the adjusting plate 17 and the holding plate 19 are configured by members separated from the movable frame 15. Both are configured so as to be functioned as an integral member by fixing the both with mounting screws 44.

Specifically, mounting plate sections 75 which are bent by 90° downward from front end edges thereof are provided in the adjusting plate 17 and the holding plate 19. Screw holes 77 for mounting the mounting screws 44 are formed in the mounting plate sections 75. In addition, mounting holes 79 having diameters greater than those of the screw holes 77 for receiving the mounting screws 44 are provided in positions facing the screw holes 77 in the movable frame 15.

In addition, an engaging concave portion 59A and an engaging concave portion 59B are respectively formed in appropriate positions in an upper end edge and a lower end edge of the front plate 43. An engaging concave portion 61A projecting on the front side in the eaves shape, which is provided in the adjusting plate 17 or the holding plate 19, is engaged with the upper engaging concave portion 59A. An engaging convex portion 61B projecting on the front side in the eaves shape, which is formed by cutting a part of a raised section 39*a* in a bottom plate 39 of the fixed frame 13, is configured to be engaged with the lower engaging concave portion 59B.

Then, the movable frame 15 having such a configuration is configured so as to be rotated back and forth of which a portion connected to the fixed frame 13 by the mounting screws 42 is the connection point O and an axis extending in the reference direction X through the connection point O is a rotation axis L.

Then, it is also possible to exhibit the same operations and effects as those of the liquid discharging apparatus 1A according to Embodiment 1 described above by the liquid discharging apparatus 1C according to the embodiment having such a configuration. Furthermore, in the embodiment, it is possible to change mounting positions of the adjusting plates 17 and the holding plates 19 or to change the mounting number thereof even after the assembly. Thus, it is possible to change the number of the adjusting plates 17 and the holding plates 19 or to change the mounting positions thereof in accordance with the size of the medium M on which recording is executed and the like.

In addition, in a case where the adjusting plate 17 and the holding plate 19 are deformed or damaged by being used, only the adjusting plate 17 and the holding plate 19 which are deformed or damaged may be replaced with new ones. Thus, it is possible to reduce waste of an integral structure which has to be replaced for each movable frame 15.

In summary, in the liquid discharging apparatus 1C, the adjusting section is configured by a member separated from the movable frame 15. Both are fixed with the mounting screws and thereby are configured so as to function as the integral member. Therefore, it is possible to adjust the number of the adjusting sections and the mounting position of each adjusting section in accordance with the length of the movable frame 15 in the reference direction X. Thus, it is possible to correspond to various movable sections 15 with different lengths in the reference direction X and the like, and to improve versatility.

In other words, in the liquid discharging apparatus 1C, the adjusting section is configured by the member separated from the movable section. Therefore, it is possible to adjust the number of the adjusting sections and the mounting position of each adjusting section in accordance with the length of the movable section in the reference direction X and the like. Thus, it is possible to correspond to various movable sections with different lengths in the reference direction X and the like, and to improve versatility. Method of Adjusting Angle of Guide Mounting Surface in Liquid Discharging Apparatus (See FIGS. 10A to 10C, 2, 6, and 7)

The embodiment is a method of adjusting an angle of a guide mounting surface in the liquid discharging apparatus executed in a case where the liquid discharging apparatus 1A according to Embodiment 1 is used.

The method of adjusting the angle of the guide mounting surface in the liquid discharging apparatus is applied to the support frame 11 in a state where the carriage 5 on which the head 3 is mounted and the linear guide 35 are assembled, the lower portion of the movable frame 15 is mounted on the raised section of the fixed frame 13 by the mounting screws 42 and is mounted on the housing 2 of the liquid discharging apparatus 1A via the side frame 6.

That is, the method of adjusting the angle of the guide mounting surface in the liquid discharging apparatus is configured by adjusting the movable frame 15 so that the angle θ of the guide mounting surface 9 becomes a predetermined angle by rotating the movable frame 15 around the rotational axis L through the connection point O by adjusting the mounting position of the adjusting plate 17 with respect to the fixed plate 45 of the fixed frame 13.

Hereinafter, contents of the embodiment will be specifically described by dividing into three steps of (1) adjusting of the mounting position of the adjusting plate, (2) mounting of the adjusting plate, and (3) mounting of the holding plate in accordance with an actual operation procedure.

Figure 10A:
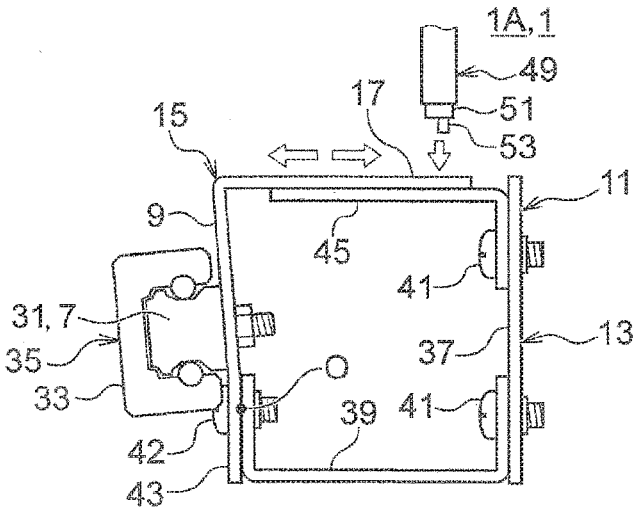
FIGS. 10A to 10C are views illustrating a method of adjusting an angle of a guide mounting surface in the liquid discharging apparatus according to the embodiment of the invention.

(1) Adjusting of Mounting Position of Adjusting Plate (See FIGS. 10A, 6, and 7)

In a case where the mounting position of the adjusting plate 17 with respect to the slide surface 45S of the fixed plate 45 is adjusted, the eccentric driver 49 described above is used. That is, the abutting shaft 51 provided on the tip side of the shaft portion of the eccentric driver 49 is inserted into the adjusting long hole 65 provided on the tip side of the adjusting plate 17 and thereby the outer peripheral surface of the abutting shaft 51 is in a state of abutting against the inner peripheral surface of the adjusting long hole 65.

Furthermore, the insertion section 53 provided on the end surface of the abutting shaft 51 is in the state of being fitted by inserting into the fitting hole 55 formed in the fixed plate 45 on the lower side.

In this state, if the shaft portion of the eccentric driver 49 is rotated by a predetermined amount in a predetermined rotating direction with the handle of the eccentric driver 49, the adjusting plate 17 is moved forward or rearward in the sliding direction by a predetermined amount that is determined by the rotating direction, the rotation amount, an eccentric amount between the abutting shaft 51 and the insertion section 53.

In addition, if the adjusting plate 17 is moved, since the upper end edge of the movable frame 15 connected to the adjusting plate 17 is also moved by the same moving amount in the same direction, the movable frame 15 is rotated by a predetermined amount in a predetermined direction around the rotational axis L. Therefore, the angle adjustment of the guide mounting surface 9 provided in the movable frame 15 is performed and the angle θ of the guide mounting surface 9 becomes an appropriate angle.

Figure 10B:
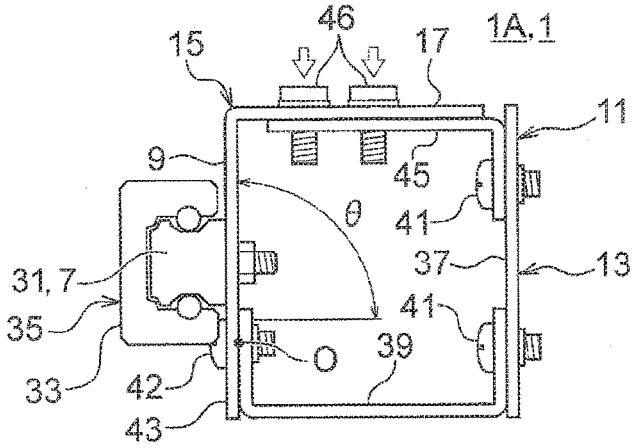

(2) Mounting of Adjusting Plate (See FIGS. 10B, 6, and 7)

The mounting screws 46 are inserted into two mounting long holes 67 provided on a base end portion side of the adjusting plate 17 in the portion in which the angle θ of the guide mounting surface 9 is adjusted to an appropriate angle in the movable frame 15 of a portion in which the adjusting plate 17 is provided. The mounting screws 46 are fastened to the screw holes 47 provided in the corresponding positions of the fixed plate 45 on the lower side and thereby the adjusting plate 17 is mounted on the fixed plate 45.

In addition, two operations of (1) adjusting of the mounting position of the adjusting plate and (2) mounting of the adjusting plate are initially performed on one side of both ends of the Home side and the Full side, and then the same operations are performed on the other side of the Home side and the Full side in a case where the adjusting plates 17 are provided in three portions of both ends of the Home side and the Full side of the movable frame 15, and the center of the movable frame 15 as in Embodiment 1 described above. Then, finally, it is preferable that the same operations are performed in the center of the movable frame 15.

Figure 10C:
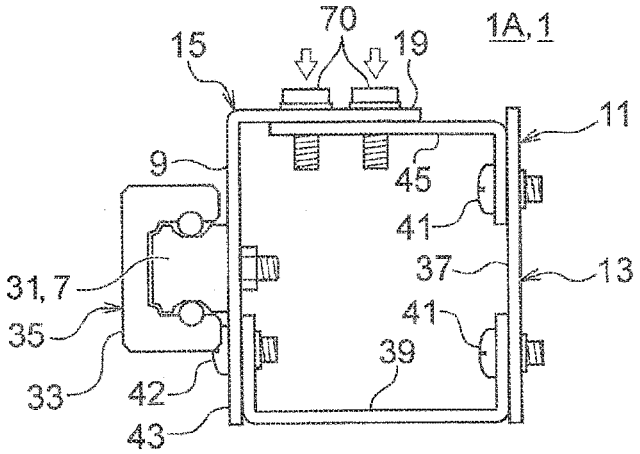

(3) Mounting of Holding Plate (See FIGS. 10C and 2)

After the angle adjustment of the guide mounting surface 9 is performed in the positions of all the adjusting plates 17, all the holding plates 19 are fixed to the fixed plate 45. That is, the fixing screws 70 are inserted into two mounting long holes 69 in each holding plate 19 and are fastened to the screw holes 47 provided in the corresponding positions of the fixed plate 45 on the lower side, and thereby the holding plate 19 is mounted on the fixed plate 45.

Therefore, the support frame 11 having high rigidity, in which the guide mounting surface 9 is held at the appropriate angle θ, is configured.

In summary, the method of adjusting the angle of the guide mounting surface 9 in the liquid discharging apparatus 1A is the method of adjusting the angle of the guide mounting surface 9 in the liquid discharging apparatus including the carriage 5 on which the head 3 is mounted and which reciprocates in the reference direction X that is the scanning direction, the guide member 7 that guides the reciprocation of the carriage 5, the support frame 11 that has the guide mounting surface 9 for mounting the guide member 7. The support frame 11 includes the fixed frame 13 and the movable frame 15 that is connected to the fixed frame 13 to be displaceable in the direction in which the angle of the guide mounting surface 9 is adjusted. The angle of the guide mounting surface 9 is adjusted by changing the connection position of the movable frame 15 with respect to the fixed frame 13. Therefore, the angle adjustment of the guide mounting surface 9 is performed by displacing the movable frame 15 with respect to the fixed frame 13, and thereby it is possible to easily adjust the angle of the guide mounting surface 9 to an appropriate angle by the displacing operation. Thus, in a case where a linear guide and the like are used as the guide member 7 of the carriage 5, even if the support frame 11 which requires a high-precision plane for mounting the guide member 7 is configured of sheet metal, it is possible to easily form the high-precision plane. That is, it is possible to easily form the high-precision plane on which the guide member 7 is mounted without using heavy and expensive rigid support base.

The method of adjusting the angle of the guide mounting surface 9 in the liquid discharging apparatus 1A can be called as a method of adjusting of the rail section in the liquid discharging apparatus 1A. The method of adjusting of the rail section in the liquid discharging apparatus 1A is a method of adjusting of the rail section in the liquid discharging apparatus 1A including the fixed section, the movable section that is mounted to be displaceable with respect to the fixed section, the rail section which has the planar portion, in which the plane is formed in the reference direction X, and in which the planar portion is fixed to the movable section, and the carriage 5 on which the head 3 that is able to discharge the liquid is mounted and which is mounted on the rail section to be movable in the reference direction X. The movable section is displaced with respect to the fixed section so as to rotate the rail section about the axis extending in the reference direction X. Therefore, it is possible to adjust the inclination of the rail section in the rotating direction about the axis extending in the reference direction X.

Other Embodiments

The liquid discharging apparatus 1 according to the invention is intended to be base by having the configuration described above, but, of course, it is possible to perform a partial configuration change, omission, and the like within the scope not departing from the gist of the invention.

For example, the liquid discharging apparatus 1 of the invention is not limited to the large ink jet printing apparatus described above and can be also applied to a large ink jet printer including a relatively large and heavy carriage 5 and the like. In addition, in an ink jet printer employing a layout in which a transport surface of the medium M is inclined, the guide mounting surface 9 is not a plane in the vertical direction but is a plane of an inclined direction as an inclination angle of the transport surface.

In addition, the guide member 7 provided in the liquid discharging apparatus 1 of the invention is not limited to the guide rail 31 for the linear guide 35 employed in the embodiment described above and can also employ another guide member 7 having a different configuration. In addition, it is also possible to provide a configuration in which the configuration of the slide block 33 of the linear guide 35 is included in the carriage 5.

In addition, in Embodiment 1 and Embodiment 2 described above, one of the adjusting plate 17 and the holding plate 19 provided as the integral member with the movable frame 15 is configured as a member separated from the movable frame 15 or in Embodiment 1, the rear plate 37, the bottom plate 39, and the fixed plate 45 of the fixed frame 13 configured in separated members can be configured as an integral member.

In addition, the adjusting unit of the mounting position of the adjusting plate 17 is not limited to the adjusting unit performing the adjustment by using the eccentric driver 49 described in the embodiments. For example, an adjusting screw is mounted on the fixed plate 45 by using an appropriate support fitting and a tip of the adjusting screw is engaged with a part of the adjusting plate 17, and thereby the mounting position of the adjusting plate 17 can be also adjusted by a feed amount corresponding to a feed pitch of a thread of the adjusting screw.

In addition, the mounting positions and the number of the adjusting plates 17 and the holding plates 19 are not limited to the mounting positions and the number thereof described in the above embodiments and can be appropriately changed in accordance with the length of the support frame 11 in the reference direction X and the like.

In addition, the upper end edge of the front plate 43 is formed to be extended and the extended portion is bent on the fixed plate 45 side and thereby it is possible to dispose a plate which includes a combination of the functions of the adjusting plate 17 and the holding plate 19 which are long in the reference direction X. In this case, it is preferable that a number of the mounting long holes 67 and the adjusting long hole 65 for the adjusting plate 17, and the mounting long holes 69 for the holding plate 19 provided in the adjusting plate 17 and the holding plate 19 of each position are formed in the plate.

This application claims priority under 35 U.S.C. § 119 to Japanese Patent Application No. 2015-206358, filed Oct. 20 2015. The entire disclosure of Japanese Patent Application No. 2015-206358 is hereby incorporated herein by reference.

What is claimed is:

1. A liquid discharging apparatus comprising:

a fixed frame section;

a movable frame section that is mounted on the frame section, the movable frame section being displaceable with respect to the fixed section and the movable frame section including a guide mounting surface;

a rail section including a plane formed substantially in parallel with a reference direction, the rail section being fixed to the movable frame section, and the plane being in contact with the guide mounting surface; and a carriage, on which a head is mounted, mounted on the rail section to be reciprocated in the reference direction, wherein the movable frame section is displaced with respect to the fixed frame section so as to rotate the rail section fixed to the movable frame section about an axis extending in the reference direction.

2. The liquid discharging apparatus according to claim 1, wherein the movable frame section rotates the rail section about the axis by being slid with respect to the fixed frame section.

3. The liquid discharging apparatus according to claim 2, further comprising:

an adjusting section that causes the movable frame section to slide with respect to the fixed frame section in accordance with the rotation of the cam section by abutting against the cam section.

4. The liquid discharging apparatus according to claim 3, wherein the adjusting section is configured of a member integral with the movable frame section.

5. The liquid discharging apparatus according to claim 3, wherein the adjusting section is configured of a member separated from the movable frame section.

6. The liquid discharging apparatus according to claim 1, further comprising:

a holding section that holds the movable frame section to be displaceable with respect to the fixed frame section, wherein a plurality of holding sections are disposed with intervals in the reference direction.

7. The liquid discharging apparatus according to claim 6, wherein the number of the holding sections disposed in a first region that is a region on one side from a center of the movable frame section in the reference direction is greater than the number of the holding sections disposed in a second region that is a region on the other side from the center of the movable frame section in the reference direction.

8. The liquid discharging apparatus according to claim 1, further comprising:

a stopper that is disposed in an end portion of the carriage on at least one side in the reference direction and is able to catch the carriage.

9. The liquid discharging apparatus according to claim 1, wherein the fixed frame section and the movable section are configured by an integral member.

10. A method of adjusting a rail section in a liquid discharging apparatus including a fixed frame section, a movable frame section that is mounted on the frame section, the movable frame section being displaceable with respect to the fixed section and the movable frame section including a guide mounting surface, the rail section including a plane formed substantially in parallel with a reference direction, the rail section being fixed to the movable frame section and the plane being in contact with the guide mounting surface, and a carriage including a head and being mounted on the rail section to be reciprocated in the reference direction, the method of adjusting the rail section comprising:

displacing the movable frame section with respect to the fixed frame section so as to rotate the rail section fixed to the movable frame section about an axis extending in the reference direction.

* * * * *